US010412509B2

(12) United States Patent
Dittberner et al.

(10) Patent No.: US 10,412,509 B2
(45) **Date of Patent: *Sep. 10, 2019**

(54) BINAURAL HEARING AID SYSTEM WITH FEEDBACK SUPPRESSION

(71) Applicant: GN HEARING A/S, Ballerup (DK)

(72) Inventors: Andrew Burke Dittberner, Antioch, IL (US); Erik Cornelis Diederik Van Der Werf, Eindhoven (NL)

(73) Assignee: GN HEARING A/S, Ballerup (DK)

( * ) Notice: Subject to any disclaimer, the term of this patent is extended or adjusted under 35 U.S.C. 154(b) by 5 days.

This patent is subject to a terminal disclaimer.

(21) Appl. No.: 15/664,576

(22) Filed: Jul. 31, 2017

(65) Prior Publication Data

US 2017/0332181 A1 Nov. 16, 2017

Related U.S. Application Data

(63) Continuation of application No. 14/141,303, filed on Dec. 26, 2013, now Pat. No. 9,723,413.

(51) Int. Cl.
*H04R 25/00* (2006.01)

(52) U.S. Cl.
CPC ..... *H04R 25/552* (2013.01); *H04R 25/453* (2013.01); *H04R 25/554* (2013.01)

(58) Field of Classification Search
CPC ..... H04R 25/552; H04R 25/554; H04R 2225/55; H04R 2201/107; H04R 2205/041
See application file for complete search history.

(56) References Cited

U.S. PATENT DOCUMENTS

| | | | | |
|---|---|---|---|---|
| 5,757,932 | A * | 5/1998 | Lindemann | H04R 25/356 381/312 |
| 8,041,066 | B2 * | 10/2011 | Solum | H04R 25/552 381/370 |
| 8,515,114 | B2 * | 8/2013 | Solum | H04R 25/552 381/370 |
| 9,723,413 | B2 | 8/2017 | Dittberner et al. | |
| 2007/0076910 | A1 | 4/2007 | Sporer | |
| 2007/0140506 | A1 * | 6/2007 | Roeck | H04R 25/552 381/77 |
| 2008/0226094 | A1 * | 9/2008 | Rutschman | H04M 1/6066 381/79 |
| 2009/0154739 | A1 * | 6/2009 | Zellner | H04R 1/1041 381/311 |

(Continued)

OTHER PUBLICATIONS

Non-final Office Action dated Oct. 8, 2015 for related U.S. Appl. No. 14/141,303, 11 pages.

(Continued)

*Primary Examiner* — Matthew A Eason
(74) *Attorney, Agent, or Firm* — Vista IP Law Group, LLP

(57) ABSTRACT

A binaural hearing aid system includes: a first hearing aid having a first microphone, a first processing unit, a first receiver, and a first communication unit; and a second hearing aid having a second microphone, a second processing unit, a second receiver, and a second communication unit; wherein the first communication unit of the first hearing aid is configured to transmit a filtered signal for reception by the second communication unit of the second hearing aid in response to a signal associated with a phone.

19 Claims, 4 Drawing Sheets

(56) References Cited

U.S. PATENT DOCUMENTS

| | | | | |
|---|---|---|---|---|
| 2009/0154742 | A1* | 6/2009 | Rasmussen | H04R 25/43 381/312 |
| 2012/0058727 | A1* | 3/2012 | Cook | H04R 5/02 455/41.3 |
| 2012/0230510 | A1* | 9/2012 | Dinescu | H04R 5/033 381/80 |
| 2012/0308019 | A1* | 12/2012 | Edwards | H04R 25/552 381/23.1 |
| 2014/0086417 | A1* | 3/2014 | Hansen | H04R 25/43 381/23.1 |
| 2015/0124976 | A1* | 5/2015 | Pedersen | H04R 25/552 381/23.1 |
| 2015/0189451 | A1 | 7/2015 | Dittberner et al. | |
| 2015/0256951 | A1* | 9/2015 | Edwards | H04R 25/552 381/315 |
| 2016/0157026 | A1* | 6/2016 | Guindi | H04R 25/305 381/60 |

OTHER PUBLICATIONS

Final Office Action dated Jun. 10, 2016 for related U.S. Appl. No. 14/141,303, 13 pages.
Non-final Office Action dated Nov. 7, 2016 for related U.S. Appl. No. 14/141,303, 20 pages.
Notice of Allowance and Fee(s) due dated Mar. 27, 2017 for related U.S. Appl. No. 14/141,303, 5 pages.

* cited by examiner

BINAURAL HEARING AID SYSTEM WITH FEEDBACK SUPPRESSION

RELATED APPLICATION DATA

This application is a continuation of U.S. patent application Ser. No. 14/141,303, filed on Dec. 26, 2013, pending. The entire disclosure of the above application is expressly incorporated by reference herein.

FIELD

An embodiment described herein relates to hearing device, such as hearing aid.

BACKGROUND

In a hearing aid, acoustical signals arriving at a microphone of the hearing aid are amplified and output with a speaker to restore audibility. In some cases, when a phone is lifted up to the ear with the hearing aid, a certain part of the frequency region becomes unstable, and may result in feedback for that given frequency region. When the feedback signal exceeds the level of the original signal at the microphone, the feedback loop becomes unstable, possibly leading to audible distortions or howling. To stop the feedback, sometimes the gain may need to be turned down. For example, in some hearing aids that have no feedback suppression, the gain may need to be turned down. Also, sometimes in a hearing aid with feedback cancellation, the gain may need to be turned down when a residual feedback (i.e., the part of the feedback signal that the feedback cancellation system fails to predict) exceeds a level of an original input signal.

The risk of feedback limits the maximum gain that can be used with a hearing aid.

Feedback suppression, especially with landline phone usage with hearing aids, continues to be a challenge for hearing aid wears. Although feedback suppression strategies have been utilized to reduce feedback, there are always trade-offs in terms of artifacts or audibility of portions of the frequency response. All current feedback suppression strategies use the hearing instrument processing capabilities to completely deal with the feedback problem.

Applicant of the subject application determines that another approach for reducing feedback associated with an operation of a phone would be desirable.

SUMMARY

A binaural hearing aid system includes: a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit; wherein the first communication unit of the first hearing aid is configured to transmit a filtered signal for reception by the second communication unit of the second hearing aid in response to a signal associated with a phone.

Optionally, the first hearing aid further includes a detector configured to detect the signal associated with the phone.

Optionally, the signal associated with the phone comprises a communication signal generated by the phone, and the detector is configured to detect the communication signal generated by the phone.

Optionally, the signal associated with the phone comprises an electromagnetic signal emitted from a coil in the phone, and the detector is configured to detect the electromagnetic signal.

Optionally, the signal associated with the phone comprises an environmental signal representing an environment in which the phone is operated, and the detector is configured to detect the environmental signal.

Optionally, the signal associated with the phone comprises a feedback signal resulted from an operation of the phone, and the detector is configured to detect the feedback signal.

Optionally, the signal associated with the phone comprises a magnetic signal from a magnet that is attached to the phone.

Optionally, when the first communication unit of the first hearing aid is transmitting the filtered signal for reception by the second communication unit of the second hearing aid in response to the signal associated with the phone, the second communication unit of the second hearing aid does not transmit any filtered signal to the first communication unit of the first hearing aid.

Optionally, the first processing unit comprises a filtering unit for providing the filtered signal.

Optionally, the filtered signal comprises a portion of a frequency band of the first audio signal provided by the first microphone of the first hearing aid.

Optionally, the first hearing aid also comprises a delay component for providing a delay for the first audio signal so that the filtered signal, when received by the second communication unit of the second hearing aid, is in synchronization with the first audio signal.

Optionally, the second communication unit of the second hearing aid is configured to transmit a filtered signal for reception by the first communication unit of the first hearing aid; and wherein only one of the first communication unit and the second communication unit is configured to transmit the corresponding filtered signal, in dependence on a position of the phone.

A binaural hearing aid system includes: a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit; wherein only one of the first communication unit and the second communication unit is configured to transmit a filtered signal in response to a signal associated with a phone in dependence on a position of the phone.

Optionally, the first communication unit, not the second communication unit, is configured to transmit the filtered signal for reception by the second communication unit if the phone is closer to the first hearing aid than the second hearing aid; and wherein the second communication unit, not the first communication unit, is configured to transmit the filtered signal for reception by the first communication unit if the phone is closer to the second hearing aid than the first hearing aid.

Optionally, the first hearing aid further comprises a detector configured to detect the signal associated with the phone; and wherein the signal associated with the phone comprises a communication signal generated by the phone, an electromagnetic signal emitted from a coil in the phone, an environmental signal representing an environment in which the phone is operated, a feedback signal resulted from an operation of the phone, or a magnetic signal from a magnet that is attached to the phone.

Optionally, the filtered signal has a frequency range that is based on a feedback model.

Other and further aspects and features will be evident from reading the following detailed description.

BRIEF DESCRIPTION OF THE FIGURES

The drawings illustrate the design and utility of embodiments, in which similar elements are referred to by common reference numerals. These drawings may or may not be drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

Below, the new hearing aid system and associated method are explained in more detail with reference to the drawings in which.

DETAILED DESCRIPTION

Figure 1:
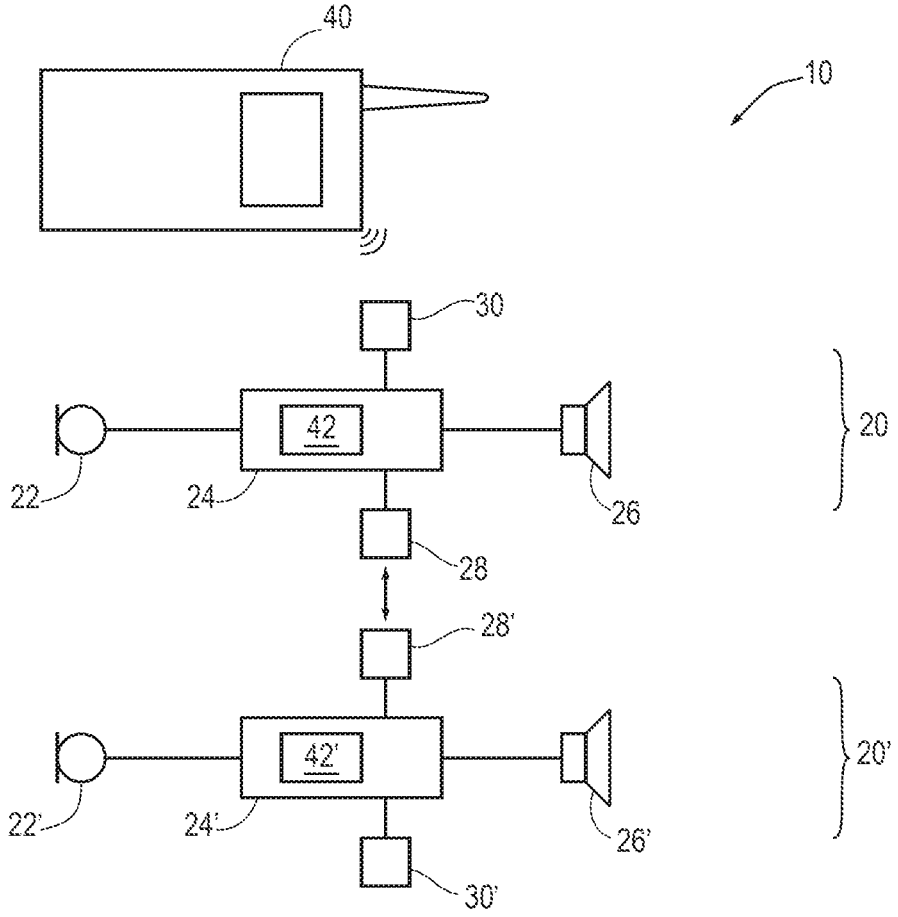
FIG. 1 illustrates a hearing aid system with feedback suppression.

Various embodiments are described hereinafter with reference to the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The new hearing aid system and associated method according to the appended claims may be embodied in different forms not shown in the accompanying drawings and should not be construed as limited to the examples set forth herein. Like reference numerals refer to like elements throughout. Like elements will, thus, not be described in detail with respect to the description of each figure.

FIG. 1 illustrates a hearing aid system 10 in accordance with some embodiments. The hearing aid system 10 includes a first hearing aid 20 and a second hearing aid 20'. One of the first hearing aid 20 and the second hearing aid 20' is configured for placement in a right ear of a user of the hearing aid system 10, and the other one of the first hearing aid 20 and the second hearing aid 20' is configured for placement in a left ear of the user of the hearing aid system 10.

As shown in the figure, the first hearing aid 20 includes a first microphone 22 for providing a first audio signal in response to sound, a first processing unit 24 configured to provide a first processed signal based at least in part on the first audio signal, a first receiver 26 (in the art of hearing aids, the speaker of the hearing aid is usually denoted the receiver) configured to provide a first sound signal based at least in part on the first processed signal, and a first communication unit 28 configured for communication with a second communication unit 28' at the second hearing aid 20'. The first communication unit 28 may include a signal transmitter, a signal receiver or a combination of signal transmitter and signal receiver (i.e. a transceiver).

Similarly, the second hearing aid 20' includes a second microphone 22' for providing a second audio signal in response to sound, a second processing unit 24' configured to provide a second processed signal based at least in part on the second audio signal, a second receiver 26' configured to provide a second sound signal based at least in part on the second processed signal, and the second communication unit 28' configured for communication with the first communication unit 28 at the first hearing aid 20. The second communication unit 28' may include a signal transmitter, a signal receiver or a combination of signal transmitter and signal receiver (i.e. a transceiver).

In an embodiment, if the first communication unit 28 of the first hearing aid comprises a transmitter, then the second communication unit 28' of the second hearing aid comprises a receiver or a transceiver. In an embodiment, if the second communication unit 28' of the second hearing aid comprises a transmitter, then the first communication unit 28 of the first hearing aid comprises a receiver or a transceiver.

The first and second processing units 24, 24' are configured to perform signal processing to compensate for hearing loss of a user of the hearing aid system 10. Each of the first and second processing units 24, 24' may include circuitry for signal processing. By means of non-limiting examples, the processing unit 24/24' may include one or more processors, such as one or more general purpose processor(s), one or more FPGA processor(s), one or more ASIC processor(s), one or more microprocessor(s), one or more signal processor(s), or combination thereof. Also, each of the processing units 24, 24' should not be limited to any particular type of processor, and may refer to any circuitry that is configured to perform signal processing. For example, in some embodiments, each of the processing unit 24, 24' may include any component(s), such as one or more filters, one or more multi-band compressors, etc., for performing any types of signal processing. Also, in some embodiments, each of the processing unit 24, 24' may include a plurality of frequency channels for processing audio signal in a plurality of frequency ranges.

As shown in FIG. 1, the first hearing aid 20 also has a first detector 30 configured to detect a signal associated with a phone 40. Similarly, the second hearing 20' also has a second detector 30' configured to detect a signal associated with the phone 40.

In some embodiments, the signal associated with the phone 40 comprises a communication signal generated by the phone 40, and the detector 30/30' is configured to detect the communication signal generated by the phone 40.

In other embodiments, the signal associated with the phone 40 comprises an electromagnetic signal emitted from a coil in the phone 40, and the detector 30/30' is configured to detect the electromagnetic signal.

In other embodiments, the signal associated with the phone 40 comprises an environmental signal representing an environment in which the phone 40 is operated, and the detector 30/30' is configured to detect the environmental signal. In such cases, each of the detectors 30, 30' may be an environment detector.

In further embodiments, the signal associated with the phone 40 comprises a feedback signal resulted from an operation of the phone 40, and the detector 30/30' is configured to detect the feedback signal.

In still further embodiments, the signal associated with the phone 40 comprises a magnetic signal provided by a magnet removably coupled to the phone 40.

As shown in FIG. 1, the first processing unit 24 of the first hearing aid 20 includes a first filtering unit 42 for providing a filtered signal. The filtered signal from the first filtering unit 42 comprises a portion of a frequency band of the first audio signal provided by the first microphone 22 of the first hearing aid 20. In some embodiments, the first filtering unit 42 may be implemented using a notch filter. In the illustrated embodiments, the portion of the frequency band of the first audio signal corresponds with the feedback resulted from an operation of a phone. In some embodiments, the portion of the frequency band may be programmed into the first processing unit 24. In other embodiments, the first processing unit 24 may be configured to automatically determine the portion of the frequency band for the filtered signal based on an actual feedback associated with an operation of the phone that is detected.

It should be noted that the filtering constraint(s) for filtering of the signal does not need to be accurate. For example, the filtering may or may not filter out all of the information associated with the feedback due to phone usage. This is because regardless of which ear receives the information, and even if there is an overlap of information between the two ears, the human brain will piece it back together. As long as whatever is filtered out on one side with the phone, and that portion is transmitted to the other ear of the user, the user will benefit at least to some extent from the techniques described herein (even if the filtered out information is only a portion of the total information associated with the feedback). Various techniques may be employed to implement the signal filtering. For example, in some embodiments, the gain of the feedback region (due to phone usage) may be reduced by a certain amount (e.g., a fixed amount) incrementally until feedback is eliminated. In other embodiments, a band-limited filter with a fixed and predetermined bandwidth may be used. Also, in some embodiments, the limited frequency band may be implemented with a few notches, each of which being a few hundred Hz wide. In other embodiments, the limited frequency band may have a wider range of frequencies, such as in the order of one to several thousands of Hz. Furthermore, in other embodiments, a feedback model may be used to determine the frequency region(s) associated with the feedback due to phone usage. In some cases, feedback may be suppressed by subtraction of a feedback model signal from a microphone signal. In still further embodiments, digital adaptive filter(s) may be used to model the feedback.

Similarly, the second processing unit 24' of the second hearing aid 20' also includes a second filtering unit 42' for providing a filtered signal. The filtered signal from the second filtering unit 42' comprises a portion of a frequency band of the second audio signal provided by the second microphone 22' of the second hearing aid 20'. In some embodiments, the second filtering unit 42' may be implemented using a notch filter. In the illustrated embodiments, the portion of the frequency band of the second audio signal corresponds with the feedback resulted from an operation of a phone. In some embodiments, the portion of the frequency band may be programmed into the second processing unit 24'. In other embodiments, the second processing unit 24' may be configured to automatically determine the portion of the frequency band for the filtered signal based on an actual feedback associated with an operation of the phone that is detected.

During use, a user of the hearing aid system 10 may pick up the phone 40, and may place the phone 40 in proximity to one of the ears. In the illustrated example, the user places the phone 40 next to the ear that has the first hearing aid 20, so that the phone 40 is closer in position to the first hearing aid 20 than the second hearing aid 20'. The first detector 30 at the first hearing aid 20 detects a signal associated with the phone 40. By means of non-limiting examples, the signal associated with the phone 40 may be a communication signal generated by the phone 40, an electromagnetic signal emitted from a coil in the phone 40, an environmental signal representing an environment in which the phone 40 is operated, a feedback signal resulted from an operation of the phone 40, or a magnetic signal from a magnet that is detachably attached to the phone 40.

In response to the signal associated with the phone 40 detected by the first detector 30, the first communication unit 28 of the first hearing aid 20 transmits a filtered signal for reception by the second communication unit 28' of the second hearing aid 20'. The filtered signal may be generated by the first filtering unit 42 (which may include one or more filters) in the first processing unit 24 of the first hearing aid 20. In some embodiments, the filtered signal comprises a portion of a frequency band of the first audio signal provided by the first microphone 22 of the first hearing aid 20. The portion of the frequency band may be associated with a feedback due to an operation of the phone 40. As a result of such filtering, a portion of a frequency band associated with feedback due to the operation of the phone 40 is filtered out from the signal before the signal is processed according to a hearing loss of the first ear of the user and subsequently converted by the first receiver 26 into a first sound signal, and the part of the signal that is filtered out in the first hearing aid 20 is transmitted to the second hearing aid 20'. The second hearing aid 20', upon reception of the filtered signal transmitted from the first hearing aid 20, processes the filtered signal according to a hearing loss of the second ear of the user using the second processing unit 24'. The processed filtered signal is then provided to the second receiver 26', which generates a second sound signal based at least in part on the processed filtered signal. It should be noted that in addition to the filtered signal, the second hearing aid 20' also simultaneously provide an input for the second receiver 26' based on audio signal generated by the second microphone 22' of the second hearing aid 20', such that the second sound signal generated by the second receiver 26' has both a first component from the filtered signal provided by the first hearing aid 20, and a second component from the audio signal generated by the second microphone 22' of the second hearing aid 20'. In an embodiment, both the filtered signal received by the second hearing aid 20' and the audio signal generated by the second microphone 22' are processed according to a hearing loss of the second ear of the user in the second processing unit 24'. Also, in some embodiments, the filtered signal (i.e., information removed from the first audio signal) transmitted to the second hearing aid 20' may optionally be synchronized with the first audio signal at the first hearing aid 20, so that both hearing aids 20, 20' are synchronized in time to present the phone audio signal simultaneously.

As illustrated in the above example, the hearing aid system 10 is advantageous because the first filtering unit 42 removes from the first hearing aid 20 the information associated with the feedback due to operation of the phone 40, thereby eliminating the feedback, and the removed information is transmitted to the second hearing aid 20', where the removed information is presented with audio signal in the second hearing aid 20' for simultaneous presentation to the user. The filtered signal (i.e., information removed from audio signal in the first hearing aid 20) received by the second hearing aid 20' may optionally be synchronized with audio signal at the first hearing aid 20. This way, the user of the hearing aid system 10 can piece back the information (phone audio signal). The auditory system of a user has the ability to take input from two ears and integrate information together. The user does not perceive any disconnect between ears as perception is based on a collection of all information from both ears resulting in a single sound object perception, not multiple sound objects. Also, utilizing the auditory system of the user of the hearing aid system 10 to handle some of the processing load provides a similar to better feedback cancellation performance (compared to existing feedback techniques) with less artifacts and no audibility loss.

In the above example, the phone 40 is placed closer to the first hearing aid 20 than the second hearing aid 20'. Thus, the filtered signal is provided by the first hearing aid 20 to the second hearing aid 20'. When the first communication unit 28 of the first hearing aid 20 is transmitting the filtered signal for reception by the second communication unit 28' of the second hearing aid 20' in response to the signal associated with the phone 40, the second communication unit 28' of the second hearing aid does not transmit any filtered signal to the first communication unit 28 of the first hearing aid 20.

In another example, the phone 40 may be placed closer to the second hearing aid 20' than the first hearing aid 20 (i.e., when the user uses the phone 40 at the other ear). In such cases, the second detector 30' at the second hearing aid 20' detects a signal associated with the phone 40. By means of non-limiting examples, the signal associated with the phone 40 may be a communication signal generated by the phone 40, an electromagnetic signal emitted from a coil in the phone 40, an environmental signal representing an environment in which the phone 40 is operated, a feedback signal resulted from an operation of the phone 40, or a magnetic signal from a magnet that is detachably attached to the phone 40.

In response to the signal associated with the phone 40 detected by the second detector 30', the second communication unit 28' of the second hearing aid 20' transmits a filtered signal for reception by the first communication unit 28 of the first hearing aid 20. The filtered signal may be generated by the second filtering unit 42' (which may include one or more filters) in the second processing unit 24' of the second hearing aid 20'. In some embodiments, the filtered signal comprises a portion of a frequency band of the second audio signal provided by the second microphone 22' of the second hearing aid 20'. The portion of the frequency band may be associated with a feedback due to an operation of the phone 40. As a result of such filtering, a portion of a frequency band associated with feedback due to the operation of the phone 40 is filtered out from the signal before the signal is converted by the second receiver 26' into a second sound signal, and the part of the signal that is filtered out in the second hearing aid 20' is transmitted to the first hearing aid 20. The first hearing aid 20, upon reception of the filtered signal transmitted from the second hearing aid 20', processes the filtered signal using the first processing unit 24. The processed filtered signal is then provided to the first receiver 26, which generates a first sound signal based at least in part on the processed filtered signal. It should be noted that in addition to the filtered signal, the first hearing aid 20 also simultaneously provide an input for the first receiver 26 based on audio signal generated by the first microphone 22 of the first hearing aid 20, such that the first sound signal generated by the first receiver 26 has both a first component from the filtered signal provided by the second hearing aid 20', and a second component from the audio signal generated by the first microphone 22 of the first hearing aid 20. Also, in some embodiments, the filtered signal (i.e., information removed from the second audio signal) transmitted to the first hearing aid 20 may optionally be synchronized with the second audio signal at the second hearing aid 20', so that both hearing aids 20, 20' are synchronized in time to present the phone audio signal simultaneously.

Thus, as illustrated in the above examples, only one of the first communication unit 28 and the second communication unit 28' is configured to transmit a filtered signal in dependence on a position of the phone 40. If the phone 40 is on the same side as the first hearing aid 20, then the filtered signal is transmitted from the first hearing aid 20 to the second hearing aid 20'. On the other hand, if the phone 40 is on the same side as the second hearing aid 20', then the filtered signal is transmitted from the second hearing aid 20' to the first hearing aid 20.

Figure 2:
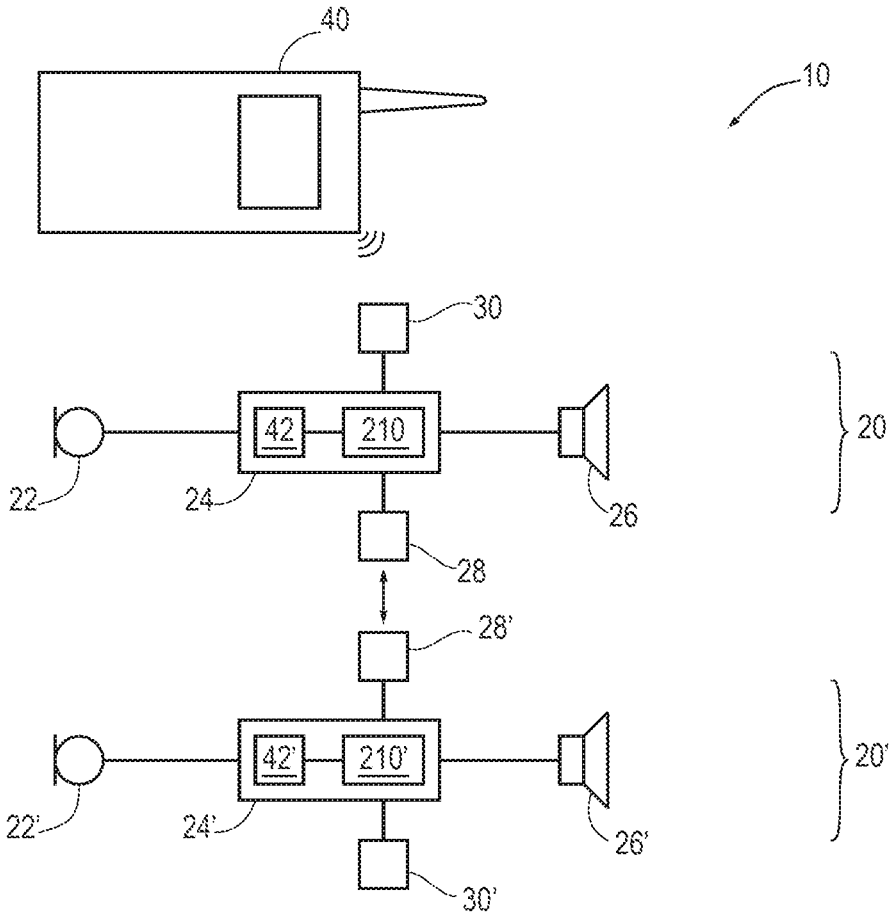
FIG. 2 illustrates a hearing aid system with feedback suppression.

In some embodiments, the hearing aid system 10 may optionally include a delay component for providing a delayed audio signal, so that the filtered signal, when received by a hearing aid (that receives the filtered signal), is synchronized with an audio signal generated by the hearing aid (that transmits the filtered signal). FIG. 2 illustrates a hearing aid system 10 in accordance with some embodiments. The hearing aid system 10 of FIG. 2 is the same as the hearing aid system 10 of FIG. 1, except that the first hearing aid 20 has a first delay component 210 for providing a delay for an audio signal generated by the first hearing aid 20. Similarly, the second hearing aid 20' has a second delay component 210' for providing a delay for an audio signal generated by the second hearing aid 20'.

The method of using the hearing aid system 10 of FIG. 2 is similar to that described with reference to FIG. 1. In the situation in which the phone 40 is placed on the side of the user where the first hearing aid 20 is wore, audio signal generated by the first microphone 22 (in response to sound from the phone 40) at the first hearing aid 20 is delayed by the first delay component 210. Such technique ensures that the filtered signal transmitted by the first hearing aid 20, when arrives at the second hearing aid 20', is synchronized with the audio signal provided by the first microphone 22 in the first hearing aid 20. The filtered signal received at the second hearing aid 20' and the audio signal at the first hearing aid 20 can then be simultaneously presented to the user, so that the user can piece back the information (phone audio signal).

In some embodiments, the amount of delay of the signal may be configured based on a transmission delay from one hearing aid to the other. For example, the transmission delay may be approximated to be a fixed value, and the fixed value of the delay may be implemented on a side where the phone is located so that the signal is aligned with the receiving side.

In other embodiments, when one hearing aid has received the filtered signal transmitted from another hearing aid (where the phone is located), the receiving hearing aid may send a signal to trigger both hearing aids to play out the audio signals. Also, in further embodiments, the signals may be time stamped to thereby allow both hearing aids 20, 20' to process the signals for simultaneous presentation to the user from both hearing aids. Regardless of the technique employed, it should be noted that the audio signals from the respective hearing aids 20, 20' do not need to be completely synchronized because the human brain would compensate for some temporal drift. Thus, as used in this specification, the term "simultaneous" or any of other similar terms (as being used to describe two hearing aids simultaneously presenting signals to a user) does not necessarily require the signals be presented simultaneously in a precise manner, and may refer to two signals that are presented substantially simultaneously (e.g., within a fraction of a second, such as within 0.5 second, or preferably within 0.3 second, and more preferably within 0.1 second, from each other). Similarly, as used in this specification, the term "synchronized" or any of other similar terms (as being used to describe two hearing aids presenting signals to a user in a synchronized manner) does not necessarily require the signals be presented synchronously in a precise manner, and may refer to two signals that are presented substantially in synchronization (e.g., within a fraction of a second, such as within 0.5 second, or preferably within 0.3 second, and more preferably within 0.1 second, from each other).

Similarly, in the situation in which the phone 40 is placed on the side of the user where the second hearing aid 20' is wore, the audio signal generated by the second microphone 22' (in response to sound from the phone 40) is delayed by the second delay component 210'. Such technique ensures that the filtered signal transmitted by the second hearing aid 20', when arrives at the first hearing aid 20, is synchronized with the audio signal provided by the second microphone 22' in the second hearing aid 20'. The filtered signal received at the first hearing aid 20' and the audio signal at the second hearing aid 20' can then be simultaneously presented to the user, so that the user can piece back the information (phone audio signal).

Figure 3:
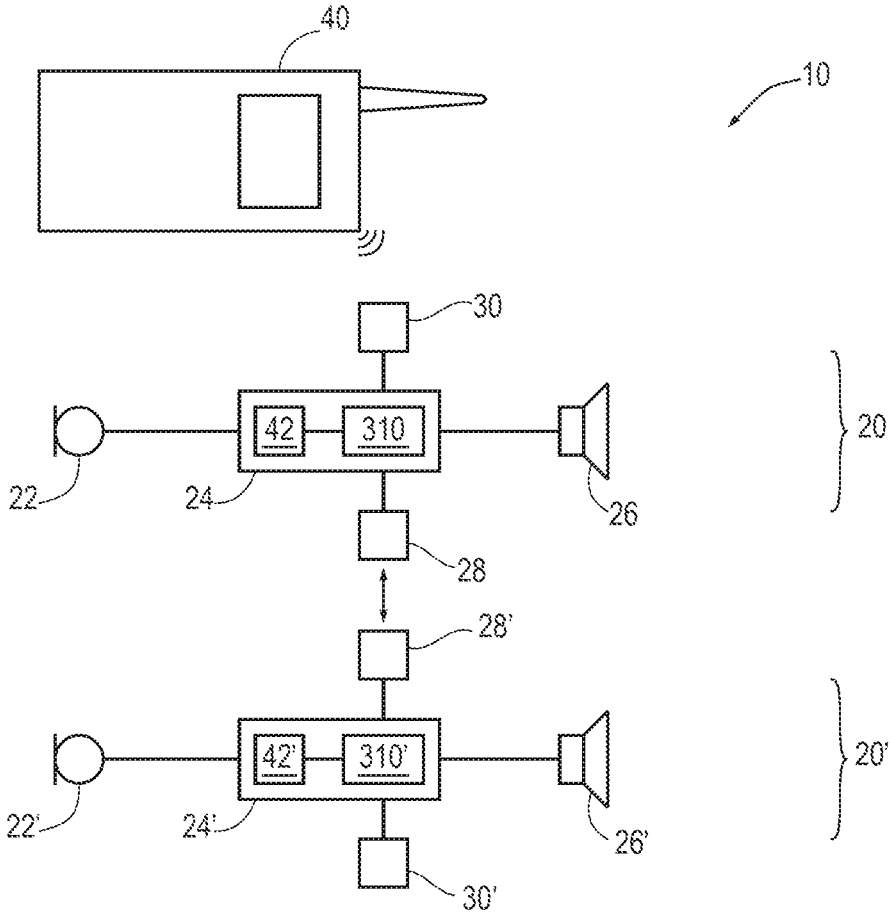
FIG. 3 illustrates a hearing aid system with feedback suppression.

In other embodiments, the hearing aid system 10 may optionally include a synchronization unit for providing a synchronized filtered signal, so that the filtered signal received by a hearing aid is synchronized with an audio signal generated by the hearing aid that transmitted the filtered signal. FIG. 3 illustrates a hearing aid system 10 in accordance with some embodiments. The hearing aid system 10 of FIG. 3 is the same as the hearing aid system 10 of FIG. 1, except that the first hearing aid 20 has a first synchronization unit 310 and the second hearing aid has a second synchronization unit 310'. The first and second synchronization units 310, 310' are configured for synchronizing an audio signal generated by the first microphone 22 of the first hearing aid 20 with a filtered signal generated by the first hearing aid 20 and transmitted to the second hearing aid 20'. The first and second synchronization units 310, 310' are also configured for synchronizing an audio signal generated by the second microphone 22' of the second hearing aid 20' with a filtered signal generated by the second hearing aid 20' and transmitted to the first hearing aid 20.

The method of using the hearing aid system 10 of FIG. 3 is similar to that described with reference to FIG. 1. In the situation in which the phone 40 is placed on the side of the user where the first hearing aid 20 is wore, the first hearing aid 20 transmits the filtered signal to the second hearing aid 20'. The first synchronization unit 310 and the second synchronization unit 310' may then corporate with each other to ensure that the filtered signal received at the second hearing aid 20' is synchronized with an audio signal generated by the first microphone 22 at the first hearing aid 20 (in response to sound from the phone 40). The filtered signal received at the second hearing aid 20' and the audio signal at the first hearing aid 20 can then be simultaneously presented to the user, so the user can piece back the information (the phone audio signal).

Similarly, in the situation in which the phone 40 is placed on the side of the user where the second hearing aid 20' is wore, the second hearing aid 20' transmits the filtered signal to the first hearing aid 20. The first synchronization unit 310 and the second synchronization unit 310' may then corporate with each other to ensure that the filtered signal received at the first hearing aid 20 is synchronized with an audio signal generated by the second microphone 22' at the second hearing aid 20' (in response to sound from the phone 40). The filtered signal received at the first hearing aid 20 and the audio signal at the second hearing aid 20' can then be simultaneously presented to the user, so the user can piece back the information (the phone audio signal).

Figure 4:
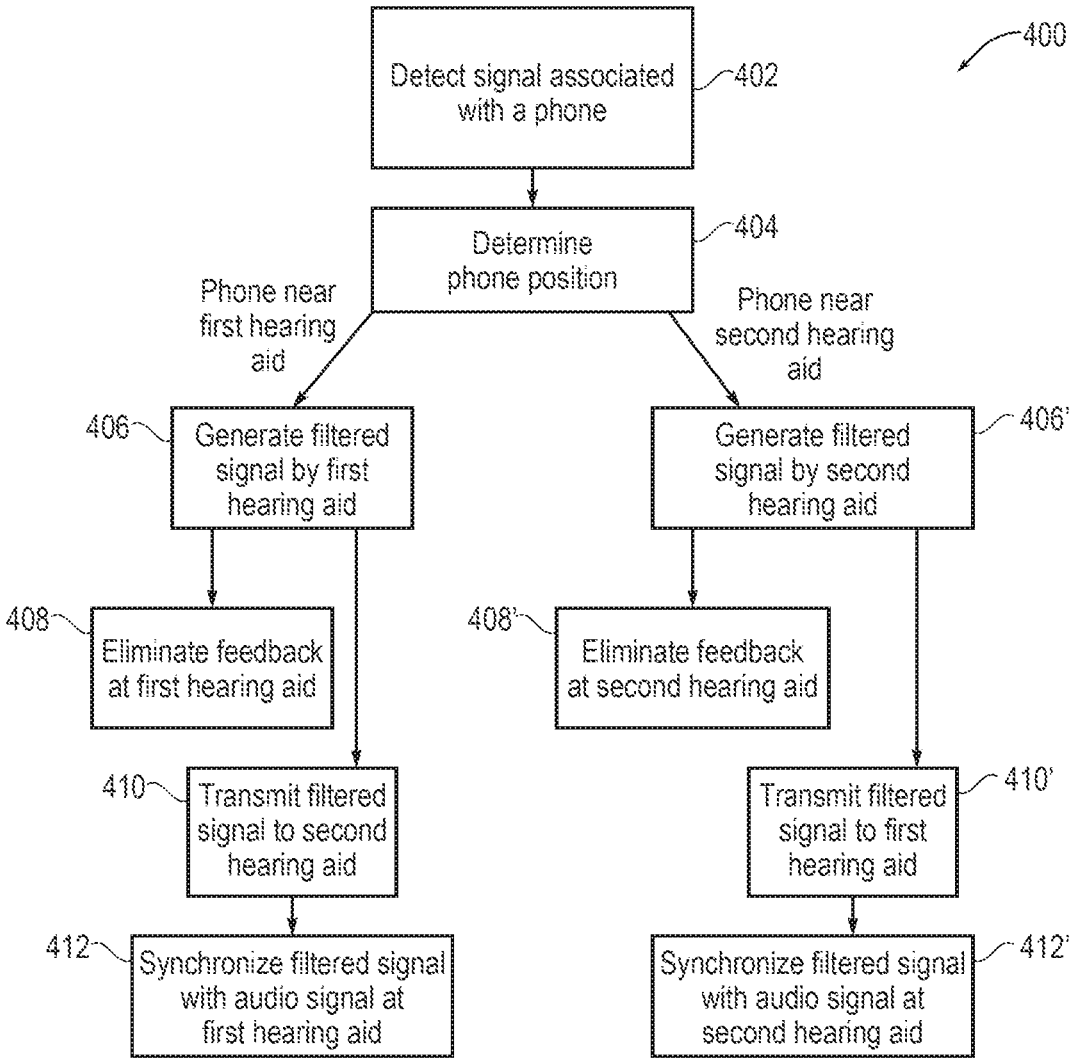
FIG. 4 illustrates a method of feedback suppression.

FIG. 4 illustrates a method 400 that may be performed using the binaural hearing aid system 10 (e.g., the binaural hearing aid system 10 of FIG. 1, 2, or 3). First, a signal associated with a phone is detected (item 402). Such may be accomplished using one or both of the first and second detectors 30 at the respective first and second hearing aids 20, 20'.

Next, a position of the phone is determined (item 404). In some embodiments, the detector 30/30' that detects the signal associated with the phone also serves to identify the position of the phone. For example, if the first detector 30 of the first hearing aid 20 detects the signal associated with the phone, then the phone is determined to be on the side of the user that has the first hearing aid 20. If the second detector 30' of the second hearing aid 20' detects the signal associated with the phone, then the phone is determined to be on the side of the user that has the second hearing aid 20'. Also, in some embodiments, if both the first and second detectors 30, 30' detect signal associated with the phone, then the processing unit 24 and/or the processing unit 24' determines the position of the phone to be on the side of the user that provides the higher detected signal.

If the position of the phone is determined to be at the ear in which the first hearing aid 20 is being worn, the first hearing aid 20 then generates a filtered signal having a portion of a frequency range that corresponds with a feedback due to an operation of the phone (item 406). The filtered signal may be generated by the first filtering unit 42 as described herein. At the first hearing aid 20, the audio signal without the filtered signal is then processed for presentation to the user, so that feedback due to the phone operation is eliminated (item 408). The filtered signal is transmitted from the first hearing aid 20 to the second hearing aid 20' using the first communication unit 28 (item 410). The filtered signal received at the second hearing aid 20' is synchronized with an audio signal from the first microphone 22 at the first hearing aid 20 for simultaneous presentation to a user of the hearing aid system 10 (item 412). In some embodiments, the audio signal at the first microphone 22 is delayed by the first hearing aid 20 (e.g., using the first delay component 210) so that the filtered signal, when received by the second hearing aid 20', is synchronized with an audio signal provided by the first microphone 22 at the first hearing aid 20. In other embodiments, the filtered signal received at the second hearing aid 20' may be synchronized with the first audio signal at the first hearing aid 20 using the first and second synchronization units 310, 310'.

If the position of the phone is determined to be at the ear in which the second hearing aid 20' is being worn, the second hearing aid 20' then generates a filtered signal having a portion of a frequency range that corresponds with a feedback due to an operation of the phone (item 406'). The filtered signal may be generated by the second filtering unit 42' as described herein. At the second hearing aid 20', the audio signal without the filtered signal is then processed for presentation to the user, so that feedback due to the phone operation is eliminated (item 408'). The filtered signal is transmitted from the second hearing aid 20' to the first hearing aid 20 using the second communication unit 28' (item 410'). The filtered signal received at the first hearing aid 20 using the first communication unit is synchronized with an audio signal from the first microphone 22 at the first hearing aid 20 for simultaneous presentation to a user of the hearing aid system 10 (item 412'). In some embodiments, the audio signal at the second hearing aid 20' is delayed by the second hearing aid 20' (e.g., using the second delay component 210') so that the filtered signal, when received by the first hearing aid 20, is synchronized with the audio signal provided by the second microphone 22' at the second hearing aid 20'. In other embodiments, the filtered signal received at the first hearing aid 20 may be synchronized with the second audio signal at the second hearing aid 20' using the first and second synchronization units 310, 310'.

Although particular embodiments have been shown and described, it will be understood that they are not intended to limit the claimed inventions, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing aid system comprising:

a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit;

wherein the first communication unit of the first hearing aid is configured to transmit a filtered signal for reception by the second communication unit of the second hearing aid in response to a signal associated with a phone; and wherein the first hearing aid also comprises a delay component for providing a delay for the first audio signal.

2. The binaural hearing aid system of claim 1, wherein the first hearing aid further comprises a detector configured to detect the signal associated with the phone.

3. The binaural hearing aid system of claim 2, wherein the signal associated with the phone comprises a communication signal generated by the phone, and the detector is configured to detect the communication signal generated by the phone.

4. The binaural hearing aid system of claim 2, wherein the signal associated with the phone comprises an electromagnetic signal emitted from a coil in the phone, and the detector is configured to detect the electromagnetic signal.

5. A binaural hearing aid system comprising:

a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit;

wherein the first communication unit of the first hearing aid is configured to transmit a filtered signal for reception by the second communication unit of the second hearing aid in response to a signal associated with a phone;

wherein the first hearing aid further comprises a detector configured to detect the signal associated with the phone; and wherein the signal associated with the phone indicates an environment in which the phone is operated.

6. A binaural hearing aid system comprising:

a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit;

wherein the first communication unit of the first hearing aid is configured to transmit a filtered signal for reception by the second communication unit of the second hearing aid in response to a signal associated with a phone;

wherein the first hearing aid further comprises a detector configured to detect the signal associated with the phone; and wherein the signal associated with the phone is resulted from an operation of the phone.

7. The binaural hearing aid system of claim 2, wherein the signal associated with the phone comprises a magnetic signal from a magnet that is attached to the phone.

8. The binaural hearing aid system of claim 1, wherein when the first communication unit of the first hearing aid is transmitting the filtered signal for reception by the second communication unit of the second hearing aid in response to the signal associated with the phone, the second communication unit of the second hearing aid does not transmit any filtered signal to the first communication unit of the first hearing aid.

9. The binaural hearing aid system of claim 1, wherein the first processing unit comprises a filtering unit for providing the filtered signal.

10. The binaural hearing aid system of claim 1, wherein the filtered signal comprises a portion of a frequency band of the first audio signal provided by the first microphone of the first hearing aid.

11. The binaural hearing aid system of claim 1, wherein the delay component is configured to provide the delay for the first audio signal so that the filtered signal, when received by the second communication unit of the second hearing aid, is in synchronization with the first audio signal.

12. The binaural hearing aid system of claim 1, wherein the second communication unit of the second hearing aid is configured to transmit a filtered signal for reception by the first communication unit of the first hearing aid; and wherein only one of the first communication unit and the second communication unit is configured to transmit the corresponding filtered signal, in dependence on a position of the phone.

13. A binaural hearing aid system comprising:

a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit;

wherein only one of the first communication unit and the second communication unit is configured to transmit a filtered signal in response to a signal associated with a phone in dependence on a position of the phone; and wherein the first hearing aid also comprises a delay component for providing a delay for the first audio signal.

14. The binaural hearing aid system of claim 13, wherein the first communication unit, not the second communication unit, is configured to transmit the filtered signal for reception by the second communication unit if the phone is closer to the first hearing aid than the second hearing aid; and wherein the second communication unit, not the first communication unit, is configured to transmit the filtered signal for reception by the first communication unit if the phone is closer to the second hearing aid than the first hearing aid.

15. The binaural hearing aid system of claim 13, wherein the first hearing aid further comprises a detector configured to detect the signal associated with the phone; and wherein the signal associated with the phone comprises a communication signal generated by the phone, an electromagnetic signal emitted from a coil in the phone, an environmental signal representing an environment in which the phone is operated, a feedback signal resulted from an operation of the phone, or a magnetic signal from a magnet that is attached to the phone.

16. A binaural hearing aid system comprising:

a first hearing aid having a first microphone for providing a first audio signal, a first processing unit configured to provide a first processed signal based at least in part on the first audio signal, a first receiver configured to provide a first sound signal based at least in part on the first processed signal, and a first communication unit; and a second hearing aid having a second microphone for providing a second audio signal, a second processing unit configured to provide a second processed signal based at least in part on the second audio signal, a second receiver configured to provide a second sound signal based at least in part on the second processed signal, and a second communication unit;

wherein only one of the first communication unit and the second communication unit is configured to transmit a filtered signal in response to a signal associated with a phone in dependence on a position of the phone;

wherein the filtered signal has a frequency range that is based on a model.

17. The binaural hearing aid system of claim 16, wherein the signal associated with the phone comprises a communication signal generated by the phone, an electromagnetic signal emitted from a coil in the phone, an environmental signal indicating an environment in which the phone is operated, a signal resulted from an operation of the phone, or a magnetic signal from a magnet that is attached to the phone.

18. The binaural hearing aid system of claim 16, wherein when the first communication unit of the first hearing aid is transmitting the filtered signal for reception by the second communication unit of the second hearing aid in response to the signal associated with the phone, the second communication unit of the second hearing aid does not transmit any filtered signal to the first communication unit of the first hearing aid.

19. The binaural hearing aid system of claim 16, wherein the first hearing aid also comprises a delay component for providing a delay for the first audio signal so that the filtered signal, when received by the second communication unit of the second hearing aid, is in synchronization with the first audio signal.

* * * * *